United States Patent [19]

Sternberg

[11] Patent Number: 4,700,405

[45] Date of Patent: Oct. 20, 1987

[54] BASEBALL GLOVE

[76] Inventor: Joseph E. Sternberg, 2198 Sycamore Hill Ct., Chesterfield, Mo. 63017

[21] Appl. No.: 825,854

[22] Filed: Feb. 4, 1986

[51] Int. Cl.[4] ..... A41D 13/08

[52] U.S. Cl. ..... 2/19; 2/161 A; 2/161 R; 2/20

[58] Field of Search ..... 2/161 A, 161 R, 158, 2/159, 20, 16, 19; 273/26 C

[56] References Cited

U.S. PATENT DOCUMENTS

| | | | |
|---|---|---|---|
| 3,031,680 | 5/1962 | Compiano | 2/161 A |
| 3,065,472 | 11/1962 | Linnell | 2/161 A |
| 3,348,238 | 10/1967 | Hydock | 2/161 A |
| 3,606,614 | 9/1971 | Dimitroff | 2/20 X |
| 3,740,766 | 6/1973 | Kobylarz | 2/161 A |
| 4,224,692 | 9/1980 | Sundberg | 2/161 R |
| 4,546,495 | 10/1985 | Castillo | 2/161 A |
| 4,559,646 | 12/1985 | Ertl | 2/161 R X |

*Primary Examiner*—Werner H. Schroeder
*Assistant Examiner*—J. L. Olds
*Attorney, Agent, or Firm*—Cohn, Powell & Hind

[57] ABSTRACT

A pair of batting gloves including a right hand glove (10) having a thumb stall (18) and a finger stall (20) accommodating a plurality of fingers and having a cushioned pad (40) thereon and an adjustable bat-engageable web (50) extending between the thumb stall (18) and the finger stall (20) and including a left hand glove having a thumb stall (68) and a finger stall (64) accommodating a plurality of fingers and having a cushioned pad (90) thereon.

13 Claims, 16 Drawing Figures

FIG. 3.
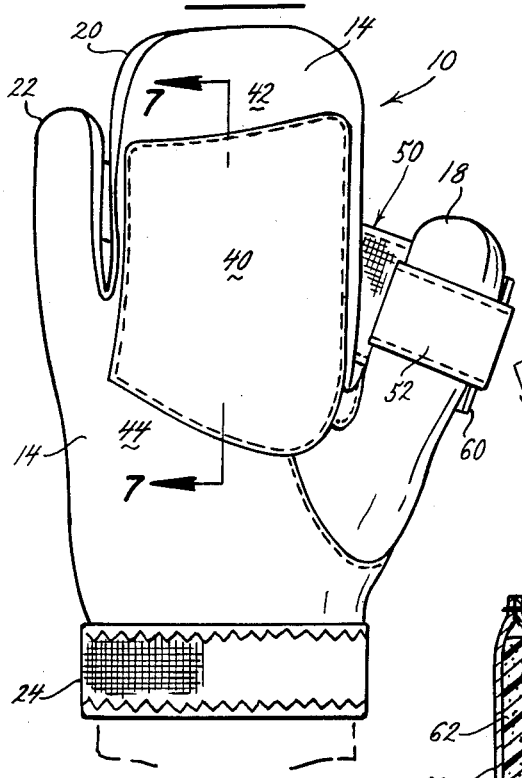
FIG. 4.
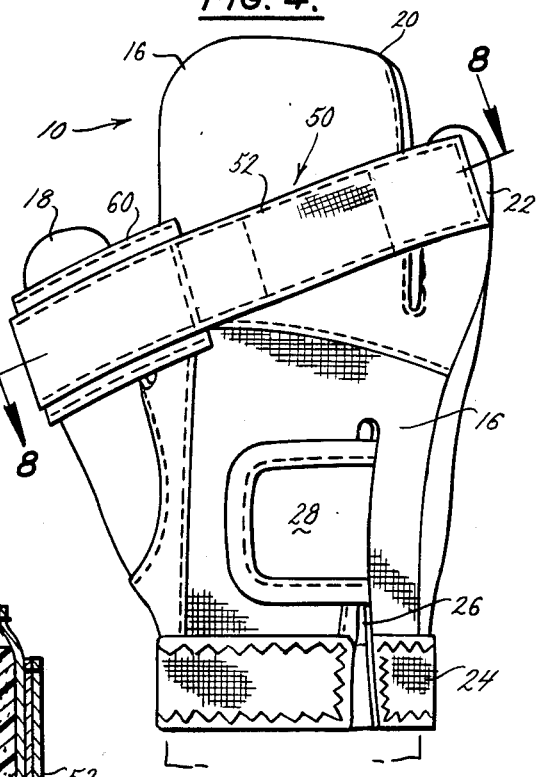
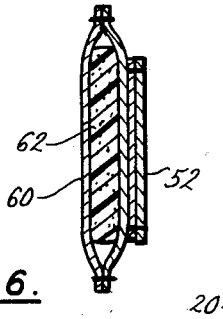
FIG. 6.
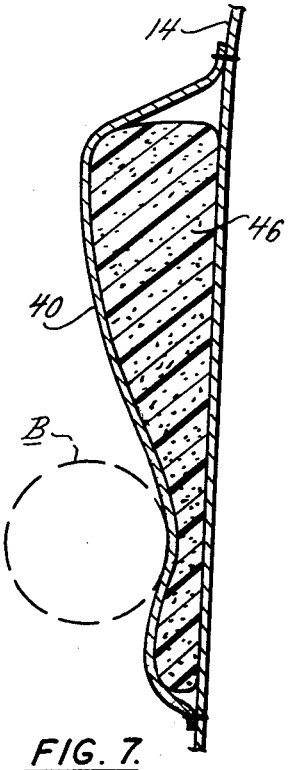
FIG. 7.
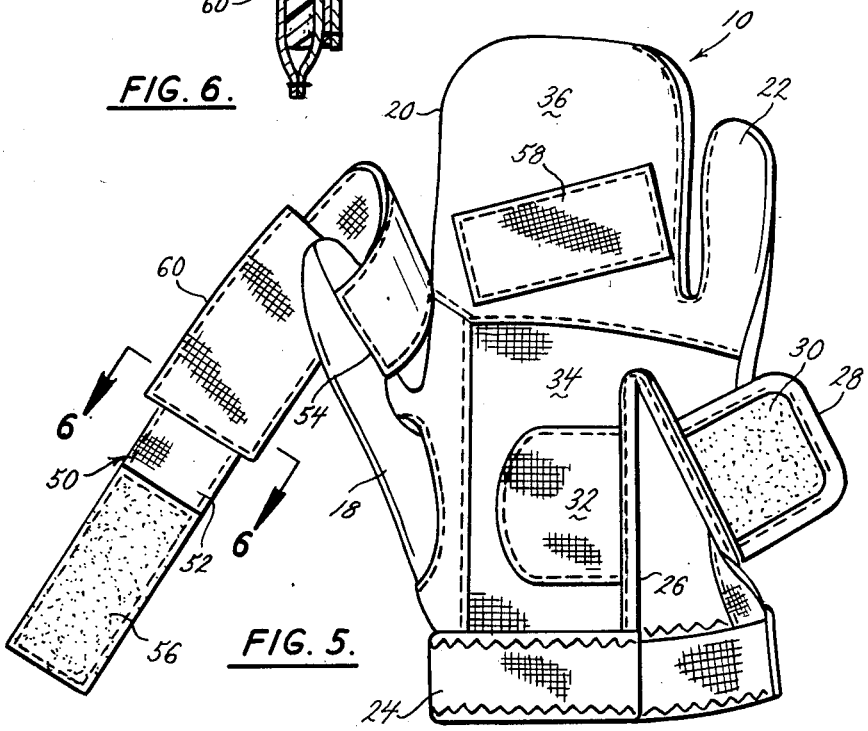
FIG. 5.

FIG. 9.
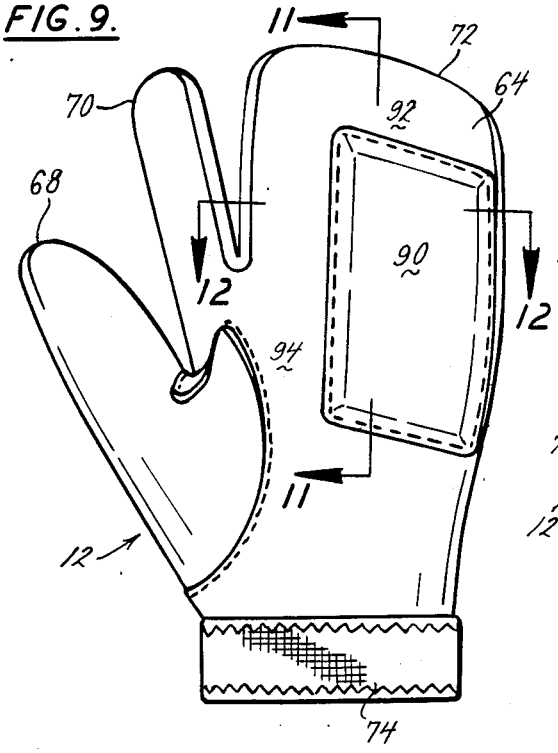
FIG 10.
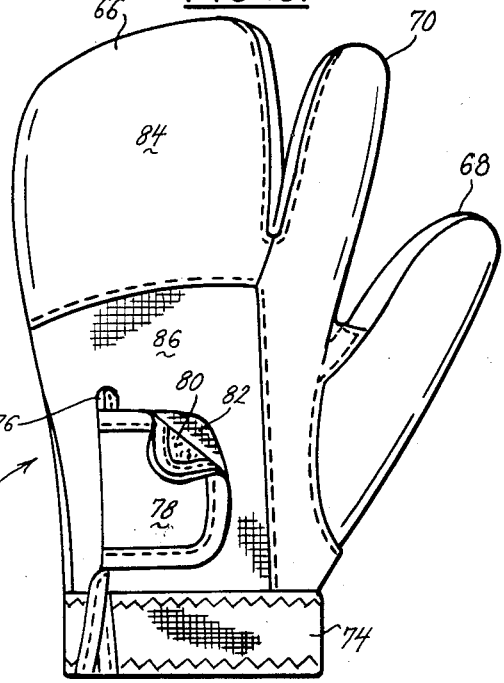
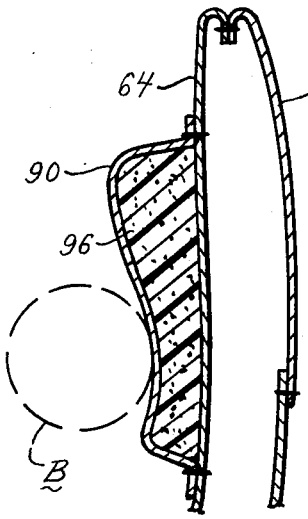
FIG. 11.
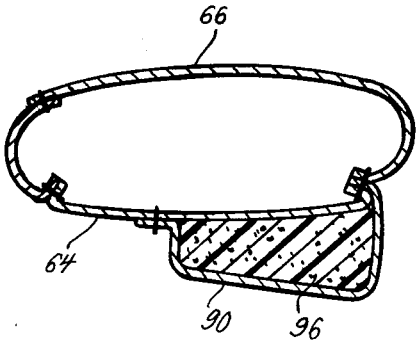
FIG. 12.
FIG. 8.
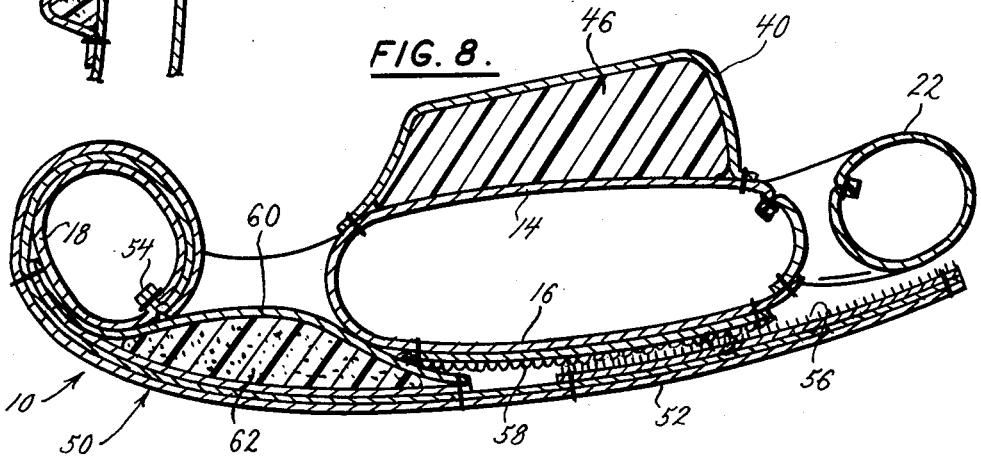

FIG. 13.
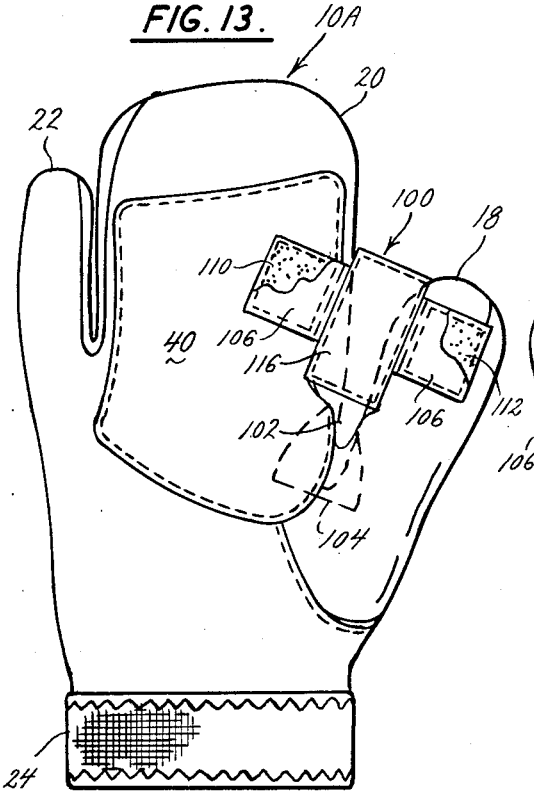
FIG. 14.
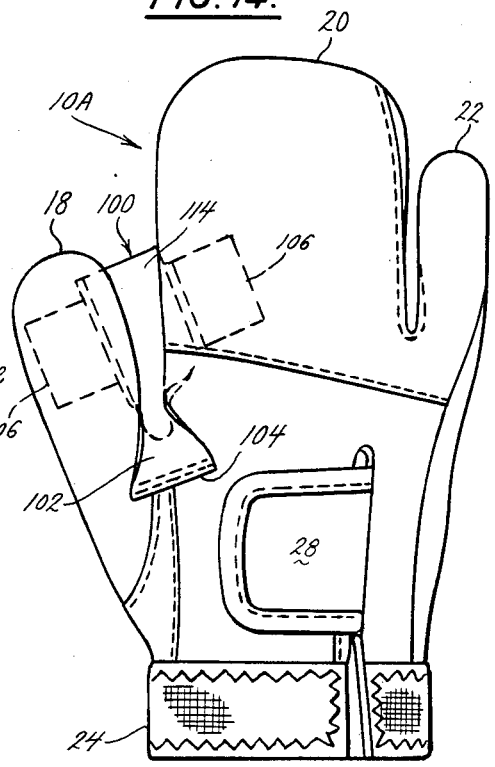
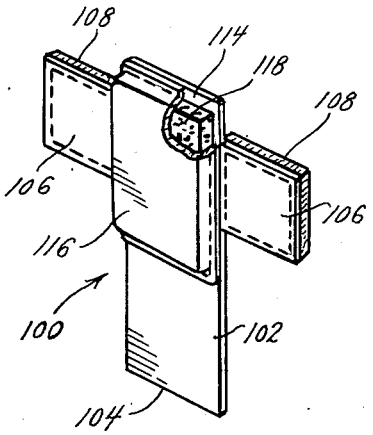
FIG. 15.
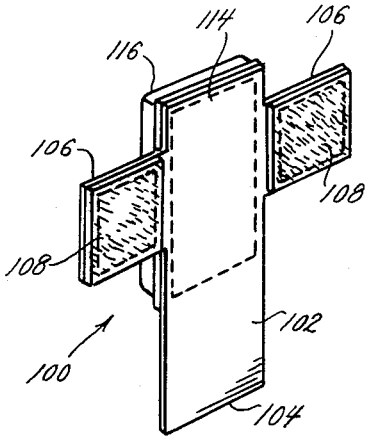
FIG. 16.

BASEBALL GLOVE

BACKGROUND OF THE INVENTION

This invention relates generally to sport gloves and particularly to gloves providing a batting aid which improves the drive power of the hitter particularly in the related sports of baseball and softball.

Sport gloves intended to improve various facets of the player's game are not in themselves new. Such gloves are particularly common in golf. One such glove, or more properly partial glove for the right hand, is shown in U.S. Pat. No. 2,436,755 which has as its aim to control of the position of the golf club at the top of the stroke, during the downward swing and impact, and to prevent the club from falling into the depression between the thumb and index finger. To this end, an adjustable strap connects the thumb and index finger stalls. Another golf glove having a connection between the thumb and index finger is shown in U.S. Pat. No. 2,751,598. This glove is for use on the left hand and is a training glove intended to correct the spacing of the thumb from the index finger and facilitate the correct application of the interlocking grip. U.S. Pat. No. 3,707,730 shows a basketball practice glove which includes an adjustable strap between the thumb and the index finger to limit the extent to which these members can be spread and cause the player's hand to form a cup-like shape so that a basketball held by the glove is controlled by the tips of the thumb and index finger.

The present glove has advantages neither shown or suggested by the above gloves or revealed in the known prior art.

SUMMARY OF THE INVENTION

In accordance with this invention, these batting gloves provide the hitter with increased power at the point of impact, reduce recoil, and enable the ball to be driven for greater distances.

The right hand and left hand gloves both include means for linking the fingers together for increased grip efficiency and means for increasing the gripping area and cushioning against shock. In addition, the right hand glove includes means for adjustably linking the thumb and adjacent fingers to effect further improvement in the power drive.

It is an object of this invention to provide a right hand glove having a first thumb stall, a second adjacent stall accommodating at least the index finger; a palm portion disposed below the finger stall; a bat engageable web extending between the thumb stall and the second stall, the web having opposed ends and being adjustable at least at one end to suit the wearer to effectively connect the thumb and the index finger, and a bat-engageable cushioning pad disposed on the front face of the second finger stall.

It is another aspect of this invention to provide a right hand glove in which the second finger stall accommodates the index, middle and ring fingers, and to provide a third finger stall which accommodates the little finger.

Yet another aspect of this invention is to provide that the bat-engageable cushioning pad is disposed on the second finger stall extending substantially thereacross and on the palm.

Another aspect of this invention is that the cushioning pad is provided with a transverse taper said cushioning pad being less thick closer to the thumb stall, to improve the fit of the bat handle to the right hand.

Still another aspect of this invention is to provide that the web is a strap attached at one end to the thumb stall and having hook and loop fasteners at the other end and to provide that the second finger stall includes cooperating hook and loop fastening means cooperating with the hook and loop fastening means on the strap.

Another aspect of this invention is to provide a modified web which includes a lower portion attached to the glove between the thumb stall and finger stall and a transverse portion having opposed ends, each end having hook and loop fastening means, and to provide the thumb stall and the finger stall with cooperating hook and loop fastening means.

It is yet another aspect of the invention to provide a left hand glove including a first thumb stall and a second, adjacent stall accommodating at least the index finger.

Another aspect of this invention is to provide a left hand glove having the second adjacent stall accommodating the index finger and a third stall accommodating the middle, ring and little fingers, said left hand glove having and a plam portion disposed below the finger stalls.

Yet another aspect of the invention is to provide a bat-engageable cushioning pad disposed on the third finger stall extending substantially thereacross and on the palm.

In still another aspect of this invention the left hand cushioning pad is tapered transversely having less thickness closer to the thumb stall to improve the fit of the bat handle to the left hand.

It is an aspect of this invention to provide a pair of batting gloves which are comfortable to wear, relatively inexpensive to produce and highly effective in use.

BRIEF DESCRIPTION OF THE DRAWINGS

FIG. 3 is a front elevational view of the right hand glove with the web attached;

FIG. 4 is a rear elevational view thereof;

FIG. 5 is a rear elevational view of the right glove with the web detached;

FIG. 6 is a transverse cross-section taken on line 6—6 of FIG. 5;

FIG. 7 is a longitudinal cross section taken on line 7—7 of FIG. 3;

FIG. 8 is a transverse cross-section taken on line 8—8 of FIG. 4;

FIG. 9 is a front elevational view of the left hand glove;

FIG. 10 is a rear elevational view thereof;

FIG. 11 is a longitudinal cross-section taken on line 11—11 of FIG. 9;

FIG. 12 is a transverse cross-section taken on line 12—12 of FIG. 9;

FIG. 13 is a front elevational view of a modified right hand glove showing the web in place;

FIG. 14 is a rear view thereof;

FIG. 15 is an enlarged perspective view of the modified web from the front, and FIG. 16 is an enlarged perspective view of the modified web from the rear.

DESCRIPTION OF THE PREFERRED EMBODIMENT

Figure 1:
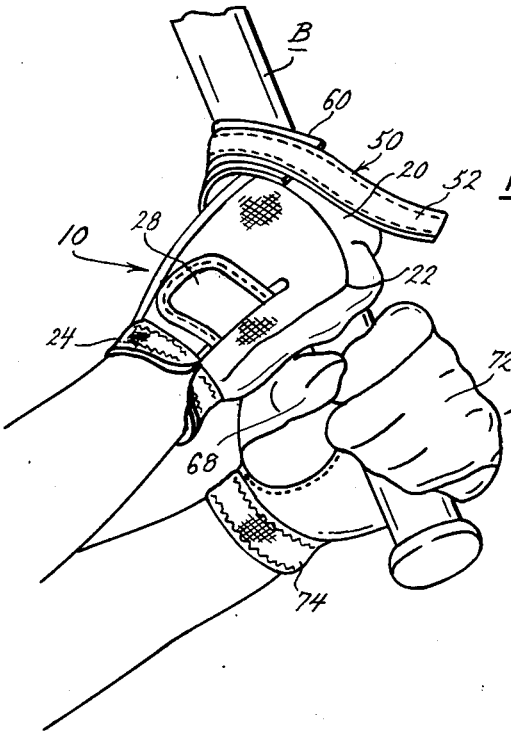
FIG. 1 is a perspective view of the gloves as worn by a right handed player, taken from one side.
Figure 2:
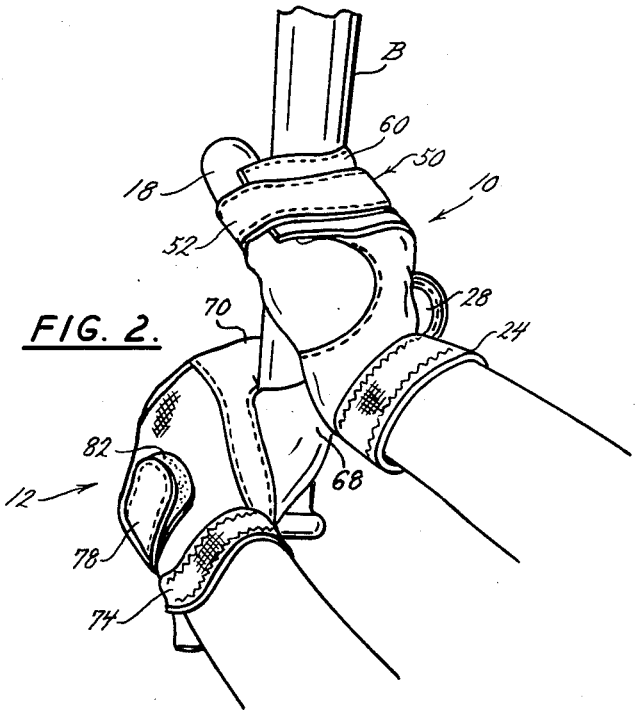
FIG. 2 is a similar view taken from the other side.

Referring now by characters of reference to the drawings and first to FIGS. 1 and 2 it will be understood that the pair of baseball hitter gloves disclosed includes a right hand glove 10 and a left hand glove 12 gripping a baseball bat B at the beginning of the swing. At the outset it should be understood that the gloves 10 and 12 are described with reference to right handed players for the reason that most players are right handed. However, it will readily be understood that the gloves can be easily modified for use by left handed players by simply applying the features of the right hand and left hand glove to the left hand and right hand respectively. The right hand glove 10 will now be described with reference to FIGS. 3–8.

The right hand glove 10, as shown in the front and rear views of FIGS. 3 and 4, has a mitten-like construction and includes a front face 14 and a rear face 16, which cooperate to define a first stall 18 accommodating the thumb of the wearer; a second, adjacent stall 20 accommodating the index, middle and ring fingers, and a third stall 22 accommodating the little finger.

A wrist portion 24 is provided which, as shown in FIG. 4, is preferrably discontinuous to form the lower portion of a slit 26 having a flap 28 attached to one margin, the flap 28 includes hook and loop fastener patch 30 on the inside face which, as shown in FIG. 5, cooperates with a hook and loop patch 32 on the rear face lower portion 36.

The front face 14 is provided with a closed cushioned pouch 40, attached thereto as by stitching, which extends between the front face upper portion 42 on the second finger stall 20, for a substantial portion of the width of said stall, and into the lower, palm portion 44. In the preferred embodiment, the pouch is cushioned by means of synthetic foam fill 46 or the like and constitutes a cushioned pad.

An adjustable web, generally indicated by numeral 50, extends between the thumb stall 18 and the adjacent finger stall 20. In the embodiment shown in FIGS. 3 and 4 the web consists of an elongate double-thickness strap 52. As best shown in FIG. 5, the strap 52 is attached at one end 54 to the thumb stall 18, as by stitching, and is provided on the inside face at the other end with a hook and loop fastener patch 56 which cooperates with a hook and loop fastener patch 58 on the rear face upper portion 36. The web 50 also includes a pouch 60 attached thereto, as by stitching, which is cushioned by synthetic foam fill 62 and constitutes an intermediate cushioned pad. The strap 52 is wrapped around the thumb stall 18 and, with the thumb stall suitably spaced from the adjacent stall to suit the comfort of the wearer, is attached to the rear face upper portion 36 so that the cushioned pad 60 is disposed in bat-engageable relation between the two stalls.

The left hand glove 12, as shown in the front and rear views of FIGS. 9 and 10, also has a mitten-like construction and includes a front face 64 and a rear face 66, which cooperate to define a first stall 68 accommodating the thumb of the wearer; a second, adjacent stall 70 accommodating the index finger, and a third stall accommodating the middle, ring and little fingers. A similar wrist portion 74 is provided and a flap 78 is attached to one margin of a slit 76, said flap having a hook and loop patch 80 on the inside face, which cooperates with a corresponding patch 82 on the rear face lower portion 86 below the upper portion 84.

The front face 64 is provided with a pouch 90, attached thereto as by stitching, which extends between the front face upper portion 92 on the third finger stall 64 and into the lower, palm portion 94 for a substantial portion of the width of the stall. In the preferred embodiment the pouch is cushioned by means of synthetic foam fill 96 and constitutes a cushioned pad.

A modified right hand glove **10*a* is shown in FIGS. 13–16. This glove is identical to the right hand glove 10** already described except for the adjustable web. Accordingly, identical numbers are used to designate identical parts where appropriate.

The modified adjustable web, generally indicated by numeral 100, extends between the thumb stall 18 and adjacent finger stall 20. The web 100 is generally tee-shaped in configuration and includes a stem portion 102, which is attached at its lower end 104 to the glove rear face 16 below the junction of stalls 18 and 20, as by stitching. The web 100 includes a transverse portion 106 provided with hook and loop fastener patches 108. The cushioned pad 40 and the thumb stall 18 are each provided with cooperating hook and loop fastener patches 110 and 112, respectively, so that the web 100 can be readily adjusted between the stalls to suit the wearer.

The upper portion 114 of the web is provided with a pouch 116 attached to said upper end, as by stitching, and said pouch is cushioned by synthetic foam fill 118 to constitute an intermediate cushioned pad. The stem 102 is pulled through the space between the stalls 18 and 20 so that the cushioned pad is disposed in bat-engageable relation between the two stalls. As will be understood increased pressure of the glove on the bat B tends to secure the hook and loop patches together.

It is thought that the structural features and functional advantages of these batting gloves have become fully apparent from the foregoing description of parts. However, for completeness of disclosure the use of the gloves will be briefly described with reference to a right handed batter and with reference to the first embodiment.

The initial batting stance is shown in FIGS. 1 and 2. From this position the forward swinging motion of the bat B is initiated by a pulling motion of the left hand. The bat travels generally butt first, in spear-like fashion, during the first portion of its travel, before the start of the turn in which the bat is swung into position to engage the ball thrown in the area of home plate. The initial pull to begin the swing is largely powered by the left hand with little contribution from the right hand. Because of the effective harnessing together of the middle, ring and little fingers in the left hand glove stall 64 and because of the provision of the generally wedge-shaped contoured cushioned pad 90, which is capable of considerable encirclement of the knob-end bat B, as indicated in FIG. 11, the pulling and gripping action are considerably enhanced during this phase. This improvement results, in part, from the effective tying together of the fingers by the mitten-like stall 64, which prevents these fingers from spreading and dissipating the power of the grip. The improvement also results, in part, from the increased gripping area available by virtue of the contoured cushioned pad 90, which is otherwise lost because of the non-conformity of the natural shape of the hand relative to the round shape of the bat handle.

At the end of the first stage of motion discussed above, when the hand travel is some twelve-eighteen inches into the swing, the effect of the left hand diminishes and the effect of the right hand becomes dominant as the swing progresses. Because of the harnessing of the index, middle and ring fingers in the stall 20 and the contoured, cushioned pad the power transmitted to the bat B by the right hand is greatly increased and, as with the left hand, the right hand cushioning pad 40 improves the grip permitting conformity of the hand to the round shape of the bat handle. In addition, because of the provision of the adjustable web 50 extending between the thumb stall 18, and the rear of the finger stall 20, the space between the thumb and adjacent fingers is effectively filled. Further, the engagement of the web cushioned pad 60 with the bat handle effectively shortens the outstanding bat length without reducing swing speed. Also it has been found that the tension on the bat handle, which is initially determined by the location of the strap, can be increased, or more finely tuned, by movement of the thumb relative to the strap.

At the point where the ability of the left hand to create forward motion diminishes and the dominance of the right hand occurs, right hand tends to pronate thus enhancing its ability to increase speed. This action results from the combination of actions discussed above, with the web additionally enhancing the pushing action, until contact is made with the pitched ball.

In general, bat recoil is proportionate to both the batter's hand size and the body strength transferred to the hands. Accordingly, when a bat is held with bare hands or with unpadded gloves the recoil is greater because of the shock, or immediacy, of the transfer and because of the lack of complete grip. As observed on high speed film this recoil distance can be several inches.

Because of the structural arrangement of parts of the gloves described above, a considerable amount of shock absorption occurs. In addition to the ability to absorb shock the gloves provide increased bat speed at impact. Further, and perhaps most importantly, at the point of impact the right and left hands cooperate to provide the necessary torque to maximize the hitting power and the decrease recoil, to enable the hitter to drive the ball farther than possible without the use of the gloves.

It will be understood that the gloves can be made from leather or synthetic material and that while the gloves described herein are particularly useful in connection with baseball, they will of course also be useful for improving the hitting power of the player in the related game of softball. Further, although game improvement is substantial with the combined use of the gloves, significant improvement is possible with each of the gloves used separately.

In view of the above, it will be seen that various aspects and features of the invention are achieved and other advantageous results attained. While a preferred embodiment of the invention has been shown and described, it will be clear to those skilled in the art that changes and modifications may be made therein without departing from the invention in its broader aspect.

I claim as my invention:

1. A batting aid comprising:

a right hand glove including a first thumb stall, a second adjacent finger stall accommodating at least the index finger, a palm portion disposed below the second finger stall, a bat-engageable web extending between the thumb stall and the second stall, said web having opposed ends and being adjustable at least at one end to suit the wearer to effectively connect the first and second stalls, and a bat-engageable cushioning pad disposed on the second finger stall.

2. A batting aid as defined in claim 1, in which:

the second finger stall accommodates the index, middle and ring fingers, and the bat-engageable cushioning pad is disposed substantially across the second finger stall.

3. A batting aid as defined in claim 2, in which:

the cushioning pad is tapered transversely having less thickness closer to the thumb stall.

4. A batting aid as defined in claim 1, in which:

the web includes an intermediate bat-engageable cushioning pad.

5. A batting aid as defined in claim 2, in which:

the web is a strap attached at one end to the thumb stall and having hook and loop fastening means at the other end, and the second finger stall includes cooperating hook and loop fastening means cooperating with the hook and loop fastening means on the strap.

6. A batting aid as defined in claim 1, in which:

the web includes a lower portion attached to the glove between the thumb stall and the finger stall and a transverse portion having opposed ends each having hook and loop fastening means, and the thumb stall and the finger stall each include hook and loop fastening means cooperating with the hook and loop fastening means on the transverse portion of the web.

7. A batting aid as defined in claim 1, in which:

a left hand glove is provided including a first thumb stall, a second adjacent finger stall accommodating the index finger, a third stall accommodating the middle, ring and little fingers, and a palm portion disposed below the finger stalls, and a bat-engageable cushioning pad is disposed on the palm portion extending substantially thereacross.

8. A batting aid as defined in claim 7, in which:

the cushioning pad is tapered transversely having less thickness closer to the thumb stall.

9. A pair of batting gloves comprising:

a right hand glove including a first, thumb stall, a second adjacent finger stall accommodating the index, middle and ring fingers and having a front face and a rear face, a third finger stall accommodating the little finger, a palm portion disposed below the finger stalls, a web extending between the first thumb stall and the second finger stall, said web having opposed ends, one end being attached to the first stall and the other end being attached to the second stall, at least one of said ends and at least one of said stalls including cooperating hook and loop fastener means to provide adjustment of said web and said web including an intermediate bat-engageable cushioning pad, and a bat-engageable cushioning pad disposed on the front face of the second finger stall and extending substantially thereacross, and a left hand glove including a first, thumb stall, a second, adjacent finger stall accommodating the index finger a third finger stall accommodating the middle, ring and little finger, a palm portion disposed below the finger stalls, and a bat-engageable cushioning pad disposed on the palm portion and extending substantially thereacross.

10. A batting aid comprising:

a right hand glove including a first stall means accommodating the thumb, a second adjacent finger stall means accommodating at least the index finger, a bat-engageable web extending between the first stall means and the second stall means, said web having opposed ends and being adjustable, at least at one end, to suit the wearer to effectively connect the first and second stall means the web including an intermediate bat-engageable cushioning pad independent of the fastening means.

11. A batting aid as defined in claim 10, in which:

the web is a strap having a width extending substantially the length of the inside of the thumb and attached at one end to the first stall means and having hook and loop fastening means at the other end, and the second stall means includes a rear face having cooperating hook and loop fastening means extending across at least two fingers for substantially the width of the strap cooperating with the hook and loop fastening means on the strap.

12. A batting aid comprising:

a right hand glove including a first stall means accommodating and covering the thumb including the thumb tip,a second, adjacent finger stall means accommodating and covering the fingers including the finger tips, and a bat-engageable web extending between the first stall means and the second stall means, said web having opposed ends and being adjustable, at least at one end, to suit the wearer to effectively connect the first and second stall means.

13. A batting aid as defined in claim 12, in which:

the second finger stall means includes a front face portion, the glove includes a palm portion providing a front face portion disposed below said finger stall means front face portion, and a bat-engageable cushioning pad is provided on one of said faces for cushioning the bat when the fingers are gripped thereabout.

* * * * *